US011788300B2

(12) United States Patent
De Rick

(10) Patent No.: US 11,788,300 B2
(45) **Date of Patent: *Oct. 17, 2023**

(54) WALL OR CEILING PANEL AND WALL OR CEILING ASSEMBLY

(71) Applicant: FLOORING INDUSTRIES LIMITED, SARL, Bertrange (LU)

(72) Inventor: Jan De Rick, Geraardsbergen (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

This patent is subject to a terminal disclaimer.

(21) Appl. No.: 17/354,396

(22) Filed: Jun. 22, 2021

(65) Prior Publication Data

US 2021/0310253 A1 Oct. 7, 2021

Related U.S. Application Data

(63) Continuation of application No. 16/625,869, filed as application No. PCT/IB2018/054697 on Jun. 26, 2018, now Pat. No. 11,072,929.

(30) Foreign Application Priority Data

| | | |
|---|---|---|
| Jun. 27, 2017 | (BE) | 2017/5454 |
| Aug. 4, 2017 | (CN) | 201720973426.4 |
| Jan. 31, 2018 | (BE) | 2018/5056 |

(51) Int. Cl.
*E04F 13/08* (2006.01)
*E04B 2/60* (2006.01)
(Continued)

(52) U.S. Cl.
CPC ..... *E04F 13/0832* (2013.01); *E04B 2/60* (2013.01); *E04F 13/0894* (2013.01);
(Continued)

(58) Field of Classification Search
CPC ..... E04F 13/0832; E04F 13/0894; E04F 13/0846; E04F 13/08; E04F 2201/0161; E04F 2201/07
(Continued)

(56) References Cited

U.S. PATENT DOCUMENTS

| | | | | |
|---|---|---|---|---|
| 502,289 A | | 8/1893 | Feldmann | |
| 1,356,590 A | * | 10/1920 | Baumann | E04B 2/22 52/574 |

(Continued)

FOREIGN PATENT DOCUMENTS

| | | |
|---|---|---|
| BE | 836440 A | 4/1976 |
| CN | 1318125 A | 10/2001 |

(Continued)

OTHER PUBLICATIONS

Search Report from corresponding European Application No. 21203901.0, dated Feb. 4, 2022.

(Continued)

*Primary Examiner* — Brian D Mattei
*Assistant Examiner* — Joseph J. Sadlon
(74) *Attorney, Agent, or Firm* — WORKMAN NYDEGGER

(57) ABSTRACT

A wall or ceiling panel, which, on one side edge, comprises a male coupling part and, on an opposite side edge, comprises a female coupling part. The male coupling part comprises a tongue and the female coupling part comprises a groove. The groove is bordered by a front lip and a rear lip, with the characteristic that the panel forms a ceiling-high wall panel and/or has a length of at least 2400 mm.

25 Claims, 7 Drawing Sheets

(51) Int. Cl.
*E04F 13/00* (2006.01)
*E04B 2/02* (2006.01)

(52) U.S. Cl.
CPC ..... *E04B 2002/0232* (2013.01); *E04F 2201/0115* (2013.01); *E04F 2201/0161* (2013.01)

(58) Field of Classification Search
USPC ..... 52/506.05
See application file for complete search history.

(56) References Cited

U.S. PATENT DOCUMENTS 1,371,856 A * 3/1921 Cade ..... E01C 5/08 404/41
1,374,082 A 4/1921 Hedges
1,477,813 A * 12/1923 Stuart ..... E04F 15/04 52/391
1,986,739 A * 1/1935 Mitte ..... E04F 13/141 52/591.4
RE22,091 E * 5/1942 Rippen ..... E04F 13/0846 219/94
2,290,369 A * 7/1942 Fleischmann ..... E04B 2/22 52/603
2,317,428 A 4/1943 Anderson
2,667,241 A * 1/1954 Shannon ..... E04B 2/60 52/762
2,799,058 A * 7/1957 Swenson ..... E04F 13/0846 24/336
2,949,763 A 8/1960 Felder
3,001,613 A 9/1961 McBerty
3,066,770 A 12/1962 Millard et al.
3,187,389 A * 6/1965 Anderson ..... E04F 13/0846 52/489.1
3,363,384 A 1/1968 Rallis
3,600,862 A 8/1971 Eckert
3,694,975 A 10/1972 Pollock
3,706,172 A 12/1972 Keith
3,714,747 A 2/1973 Curran
3,828,493 A 8/1974 Vezmar
3,919,443 A 11/1975 Porter
4,037,377 A * 7/1977 Howell ..... E04C 2/296 52/592.1
4,104,840 A 8/1978 Heintz et al.
4,187,653 A * 2/1980 Kliewer, Jr. ..... E04B 2/60 52/98
4,195,459 A 4/1980 Anderson
4,196,554 A * 4/1980 Anderson ..... E04D 3/358 52/394
4,223,490 A * 9/1980 Medow ..... E04F 13/185 52/553
4,282,687 A * 8/1981 Teleskivi ..... E06B 5/16 428/688
4,304,083 A 12/1981 Anderson
4,316,351 A 2/1982 Ting
4,467,582 A 8/1984 Hague
4,546,590 A 10/1985 Finch et al.
5,050,362 A 9/1991 Tal et al.
5,148,850 A * 9/1992 Urbanick ..... E06B 3/486 16/225
5,274,979 A * 1/1994 Tsai ..... E04F 13/0878 52/610
5,287,670 A 2/1994 Funaki
5,349,796 A * 9/1994 Meyerson ..... E04B 7/22 52/309.11
5,443,878 A 8/1995 Treloar et al.
5,497,589 A * 3/1996 Porter ..... E04C 2/296 52/800.1
5,595,038 A 1/1997 Prestenback
5,860,267 A 1/1999 Pervan
6,214,436 B1 4/2001 Catta et al.
6,247,285 B1 * 6/2001 Moebus ..... E04F 15/04 52/480
6,282,858 B1 9/2001 Swick
6,315,489 B1 11/2001 Watanabe
6,332,733 B1 * 12/2001 Hamberger ..... C08L 81/06 52/592.4
6,418,683 B1 * 7/2002 Martensson ..... E04F 13/0878 52/592.1
6,536,178 B1 * 3/2003 Pålsson ..... B44C 3/123 52/392
6,647,689 B2 * 11/2003 Pletzer ..... E04F 15/04 52/592.4
6,772,568 B2 * 8/2004 Thiers ..... E04F 15/045 52/592.1
6,851,241 B2 * 2/2005 Pervan ..... E04F 15/04 52/592.1
7,010,894 B1 3/2006 Cappelle
7,150,135 B2 * 12/2006 Becker ..... F16B 5/0044 52/592.4
7,171,791 B2 * 2/2007 Pervan ..... E04F 15/04 52/592.1
7,251,916 B2 * 8/2007 Konzelmann ..... E04F 15/04 52/592.1
7,337,588 B1 3/2008 Moebus
7,442,423 B2 * 10/2008 Miller ..... B32B 17/062 52/390
7,621,589 B1 11/2009 Gerome
7,637,068 B2 12/2009 Pervan
7,644,556 B2 1/2010 Grohman et al.
7,654,055 B2 2/2010 Ricker
7,661,228 B1 2/2010 Nolte et al.
7,748,181 B1 7/2010 Guinn
7,892,617 B2 * 2/2011 Bathelier ..... E04F 15/02 428/221
7,958,689 B2 * 6/2011 Lei ..... E04F 15/02 52/592.1
7,975,451 B2 * 7/2011 Leopolder ..... E04F 13/0889 52/592.1
7,980,036 B2 7/2011 Takayasu et al.
8,061,104 B2 11/2011 Pervan
8,205,395 B2 * 6/2012 Jakiel ..... A47F 5/0846 52/36.5
8,347,577 B2 1/2013 Aboukhalil
8,499,521 B2 8/2013 Pervan et al.
8,516,767 B2 8/2013 Engstrom
8,528,290 B2 * 9/2013 Oh ..... E04F 15/04 52/592.1
8,534,003 B2 * 9/2013 Curry, III ..... E04C 2/40 52/592.1
8,544,231 B2 10/2013 Hannig
8,544,232 B2 10/2013 Wybo et al.
8,596,013 B2 * 12/2013 Boo ..... E04C 2/38 52/588.1
8,607,532 B2 * 12/2013 Permesang ..... E04F 13/0846 24/336
8,703,299 B2 * 4/2014 Park ..... B32B 21/047 428/167
8,733,057 B2 5/2014 Seitner
8,756,899 B2 6/2014 Nilsson et al.
8,763,340 B2 7/2014 Pervan et al.
8,793,956 B2 * 8/2014 Leopolder ..... E04F 13/08 52/592.1
8,795,813 B2 8/2014 Olvey
8,806,832 B2 8/2014 Kell
8,833,026 B2 * 9/2014 Devos ..... E04B 5/00 52/592.1
8,850,772 B1 10/2014 Stanfill
8,898,977 B2 12/2014 Gulino
8,920,876 B2 12/2014 Vetter et al.
8,950,148 B2 2/2015 De Boe
9,032,678 B2 5/2015 Shaw et al.
9,068,357 B2 * 6/2015 Duernberger ..... E04F 13/0898
9,109,363 B2 * 8/2015 Grau ..... E04F 13/0894
9,109,366 B2 * 8/2015 Schulte ..... E04F 13/0894
9,175,703 B2 * 11/2015 Maertens ..... A47B 96/206
9,181,716 B1 * 11/2015 Gibson ..... E04B 1/38
9,199,271 B2 * 12/2015 Kawakami ..... B05D 3/06
9,260,870 B2 * 2/2016 Vermeulen ..... C08L 81/06 52/592.4

(56) References Cited

U.S. PATENT DOCUMENTS

| | | | | |
|---|---|---|---|---|
| 9,506,252 | B2 | 11/2016 | Molteni | |
| 9,528,275 | B2 | 12/2016 | Cappelle et al. | |
| 9,562,362 | B2 * | 2/2017 | Sprott | B29C 66/435 |
| 9,611,659 | B2 * | 4/2017 | Baert | B32B 29/007 |
| 9,611,859 | B2 | 4/2017 | Schwarz et al. | |
| 9,695,851 | B2 | 7/2017 | Hannig | |
| 9,874,028 | B2 | 1/2018 | Boucke et al. | |
| 9,938,725 | B2 * | 4/2018 | Johnson | E04F 13/0898 |
| 10,011,997 | B1 * | 7/2018 | Bilge | E04F 13/0801 |
| 10,017,944 | B2 | 7/2018 | Boettcher | |
| 10,156,045 | B2 | 12/2018 | Penland et al. | |
| 10,183,463 | B2 | 1/2019 | Lath | |
| 10,190,611 | B2 | 1/2019 | Hannig | |
| 10,280,627 | B2 | 5/2019 | De Rick et al. | |
| 10,323,420 | B2 | 6/2019 | Hensiek et al. | |
| 10,378,220 | B2 | 8/2019 | Paul et al. | |
| 10,428,534 | B2 | 10/2019 | Cappelle | |
| 10,442,152 | B2 * | 10/2019 | Schulte | B32B 21/12 |
| 10,550,581 | B2 | 2/2020 | Fjetland | |
| 10,612,250 | B2 | 4/2020 | De Rick et al. | |
| 10,876,301 | B2 | 12/2020 | Hannig et al. | |
| 10,995,499 | B2 | 5/2021 | De Rick et al. | |
| 11,072,156 | B2 * | 7/2021 | Schulte | B32B 38/10 |
| 11,149,444 | B2 | 10/2021 | Bergelin et al. | |
| 11,479,978 | B2 | 10/2022 | De Rick et al. | |
| 11,486,147 | B2 | 11/2022 | Bevernage et al. | |
| 2005/0193641 | A1 | 9/2005 | Fischer | |
| 2006/0010820 | A1 * | 1/2006 | Schwitte | E04F 15/02144 52/592.1 |
| 2006/0090414 | A1 | 5/2006 | Ye | |
| 2006/0117685 | A1 | 6/2006 | Kenessey | |
| 2006/0117699 | A1 | 6/2006 | Di Trapani | |
| 2006/0174974 | A1 * | 8/2006 | Brannstrom | B32B 7/022 144/345 |
| 2008/0216435 | A1 | 9/2008 | Nolan | |
| 2008/0226865 | A1 * | 9/2008 | Ljosland | B27B 5/075 156/247 |
| 2008/0263987 | A1 | 10/2008 | Leopolder et al. | |
| 2008/0295438 | A1 | 12/2008 | Knauseder | |
| 2009/0094914 | A1 | 4/2009 | Jambois et al. | |
| 2009/0133354 | A1 | 5/2009 | Spear et al. | |
| 2009/0260313 | A1 * | 10/2009 | Segaert | B44C 5/043 52/592.1 |
| 2010/0293879 | A1 | 11/2010 | Pervan et al. | |
| 2011/0131909 | A1 | 6/2011 | Hannig | |
| 2012/0042595 | A1 | 2/2012 | De Boe | |
| 2012/0247042 | A1 | 10/2012 | Clancy et al. | |
| 2012/0279158 | A1 | 11/2012 | Konstanczak | |
| 2013/0180197 | A1 | 7/2013 | Gompper | |
| 2013/0309441 | A1 | 11/2013 | Hannig | |
| 2013/0318897 | A1 | 12/2013 | Conterno | |
| 2013/0333182 | A1 | 12/2013 | Pervan et al. | |
| 2015/0082727 | A1 | 3/2015 | Laufer et al. | |
| 2016/0060878 | A1 | 3/2016 | Everhart, II et al. | |
| 2017/0268545 | A1 | 9/2017 | Hannig | |
| 2017/0350139 | A1 | 12/2017 | De Rick et al. | |
| 2019/0257092 | A1 | 8/2019 | De Rick et al. | |
| 2020/0217082 | A1 | 7/2020 | De Rick et al. | |
| 2021/0254350 | A1 | 8/2021 | Rick et al. | |

FOREIGN PATENT DOCUMENTS

| | | | | |
|---|---|---|---|---|
| CN | 1484728 | A | 3/2004 | |
| CN | 1531617 | A | 9/2004 | |
| CN | 1678802 | A | 10/2005 | |
| CN | 1942638 | A | 4/2007 | |
| CN | 101910528 | A | 12/2010 | |
| CN | 102165124 | A | 8/2011 | |
| CN | 102421973 | A | 4/2012 | |
| CN | 202745328 | U | 2/2013 | |
| CN | 103477004 | A | 12/2013 | |
| CN | 104032920 | A | 9/2014 | |
| CN | 105178554 | A | 12/2015 | |
| CN | 106103862 | A | 11/2016 | |
| CN | 205907969 | U | 1/2017 | |
| DE | 19503948 | A1 * | 8/1996 | E04F 13/0862 |
| DE | 19503948 | A1 | 8/1996 | |
| DE | 10034407 | C1 | 10/2001 | |
| DE | 10034407 | C1 * | 10/2001 | B32B 21/00 |
| DE | 202005004537 | U1 | 6/2005 | |
| DE | 102004054368 | | 5/2006 | |
| DE | 102004054368 | A1 * | 5/2006 | E04F 15/02 |
| EP | 1223265 | A2 | 7/2002 | |
| EP | 1223265 | A2 * | 7/2002 | E04F 15/04 |
| EP | 1343943 | B1 | 2/2006 | |
| EP | 1726735 | A1 | 11/2006 | |
| FR | 2459335 | A1 | 1/1981 | |
| RU | 2348774 | C2 | 3/2009 | |
| RU | 137044 | U1 | 1/2014 | |
| WO | 0138668 | A1 | 5/2001 | |
| WO | 2009096674 | A2 | 8/2009 | |
| WO | 2013156985 | A1 | 10/2013 | |
| WO | 2016113677 | A1 | 7/2016 | |

OTHER PUBLICATIONS

Search Report from corresponding European Application No. 21203906.9, dated Feb. 9, 2022.

Office Action from corresponding Chinese Application No. 201880042781.7, dated Dec. 1, 2020.

Chinese Office Action's "Common Technical Means in the Art", http://img.duxiu.eom/n/jpgfs/book/base . . . , Retrieved Nov. 23, 2020, 4 pages.

Belgian Search Report from corresponding BE Application No. 201705454, dated Mar. 23, 2018.

International Search Report from corresponding PCT Application No. PCT/IB2018/054697, dated Dec. 4, 2018.

* cited by examiner

WALL OR CEILING PANEL AND WALL OR CEILING ASSEMBLY

BACKGROUND OF THE INVENTION

1. Field of the Invention

The present invention relates to a wall or ceiling panel, as well as to a wall or ceiling assembly comprising such wall or ceiling panel.

More particularly, the invention relates to a wall or ceiling panel, herein in short called "panel", of the type which, on one side edge of the panel, comprises a male coupling part and, on an opposite side edge of the panel, comprises a female coupling part, wherein the coupling parts are configured such that two of such panels, by means of the coupling parts, can be coupled to each other in a plane and thus a coupled condition can be realized between the panels; wherein the male coupling part comprises a tongue and the female coupling part comprises a groove, which tongue and groove, in the coupled condition, form a tongue and groove connection, which realizes a mechanical locking between the panels in the direction perpendicular to the plane of the panels; wherein the groove is bordered by a front lip and a rear lip; and wherein the coupling parts each comprise a locking part, which locking parts, in the coupled condition, realize a mechanical locking between the panels in the direction in the plane of the panels and perpendicular to the side edges.

Thus, the locking parts, in the coupled condition, counteract the moving apart of the tongue and the groove in the direction in the plane of the coupled panels and perpendicular to the side edges.

The term "mechanical locking" indicates a locking realized in a mechanical manner. Thus, for realizing the locking no glue or the like is required. However, it is not excluded that glue or the like is used in the coupling. Glue or the like can be used, for example, for reinforcing the locking or for counteracting water penetration in the coupling.

2. Related Art

Panels of the aforementioned type are known from document EP 1 343 943. According to this document, the panels are attached to a hard and flat substructure and coupled to each other. The substructure consists, for example, of wood or metal. Now, it seems that the mutual coupling of the panels is not without risk. Inserting the male coupling part into the female coupling part is not always performed equally smooth. Often, the male coupling part must be urged into the female coupling part with a certain force. Thereby, there is a risk of damaging the coupling parts. Due to this damage, it may happen that the locking between the panels is not optimum or even fails.

SUMMARY OF THE DISCLOSURE

The invention aims at offering a solution to the aforementioned problem with the panels of the state of the art.

To this aim the invention, according to a first independent aspect, relates to a panel of the aforementioned type, with the characteristic that the rear lip is configured such that the rear lip, or at least a part thereof, can bend in rearward direction, even if the panel or the rear lip is attached, for example, to a flat substructure. The rearward bending of the rear lip provides for that the groove is enlarged. Thereby, the tongue can be brought into the groove more easily. Thus, coupling is performed more smoothly. Also, the risk of damaged coupling parts and a possibly failing locking combined therewith is smaller. In fact, less forcing is necessary to get the male coupling part into the female coupling part.

The inventor has found that such rearward bending is not possible with the panels of the state of the art. The attachment on the hard and flat substructure is preventing this. The situation is different with floor panels. Floor panels typically are installed on a flat but soft subfloor. In that case, the lowermost lip can be bent downward indeed. The soft subfloor in fact can be deformed or compressed.

The possibility of the rear lip bending rearward also provides for that, in the coupled condition, a possible expansion and/or shrinkage of the panels, for example, under the influence of moisture and/or heat, can be compensated more easily. In fact, the bendability of the rear lip can provide for a certain movability of the coupled panels in mutual respect. Thus, it is not necessary to provide a play between the coupled panels in order to absorb the expansion and/or shrinkage.

It is also noted that this preferably relates to an elastic bending of the rear lip.

The first aspect of the invention preferably is applied when the locking part of the male coupling part is provided on the rear side of the tongue and the locking part of the female coupling part on the front side of the rear lip. Then the rearward bending of the rear lip can provide for a rearward moving of the locking part on the rear lip. In particular, this relates to a rearward tilting of the locking part on the rear lip. By this rearward bending or tilting, the locking part on the tongue can be brought very easily behind the locking part on the rear lip.

The rear lip preferably is provided with a recess which allows the aforementioned rearward bending. The recess is provided at the rear side of the rear lip. The recess can be manufactured, for example, by means of a cutting or milling treatment.

The recess can be provided on the open or free end of the rear lip. Preferably, the recess extends from that open or free end to beyond the active locking zone defined by the locking parts. The active locking zone is the zone where the locking parts, in the coupled condition, work in conjunction or, in particular, contact each other. The relatively deep recess provides for that the locking parts can be brought behind each other in an extremely smooth manner. This is the case, for example, when the one locking part is situated on the rear side of the tongue and the other locking part is situated on the front side of the rear lip. Then, it can be achieved, by the relatively deep recess, that the locking part on the rear lip can be moved or tilted relatively far in rearward direction and the locking part on the tongue can be brought there behind very easily.

The rear lip can be longer than the front lip. This means that the rear lip extends beyond the open or free end of the front lip. Such long rear lip is useful, for example, with coupling parts of the turning type. The turning movement then can be performed in a smooth manner. Coupling parts of the turning type are extremely advantageous with the type of panels to which the invention is relating. In fact, wall and ceiling panels typically are rather large and heavy, however, by the turning movement still can be coupled to each other relatively easy. With such longer rear lip, the active locking zone defined by the locking parts can be situated partially, and preferably entirely, beyond the open or free end of the front lip.

The portion of the rear lip which extends beyond the open or free end of the front lip, preferably is longer than the thickness of the panel. This is useful, amongst others, when one or more attachment elements are provided on the rear lip for securing the panel to the substructure. Such rather long rear lip then in fact provides for that there is sufficient room for providing the attachment element.

When a longer rear lip is applied, the most proximally situated point of the recess on the rear side of the rear lip preferably is situated at a distance different from zero from the open or free end of the front lip. This is advantageous, amongst others, when the panel is secured to the substructure by means of an attachment element through the rear lip. The attachment element then can be provided, for example, between the open or free end of the front lip and the recess. In this way, the attachment element has no to little influence on the bending of the rear lip realized by the recess.

The coupling parts preferably are of the turning type. This means that the configuration of the coupling parts allows coupling the panels via a turning movement, and in particular allows bringing the locking parts behind each other by means of such movement. By such "turning movement", a turning or rotation movement of the one panel in respect to the other panel is meant, around an axis parallel to the side edges. Such turning movement is highly suitable for smoothly coupling the panels to each other. In the turning movement, a snap or click effect may or may not occur, which effect, if it occurs, preferably is obtained by a rearward bending and subsequently, partially or entirely, springing back or relaxing of the rear lip. It is clear that the invention certainly is advantageous with such turning connection with snap or click effect, as the invention just allows bending the upper lip in rearward direction in the secured position of the panel.

In an alternative, the coupling parts can be of the snap type. With that type of coupling parts, the configuration of the coupling parts allows coupling the panels via a snap movement and in particular bringing the coupling parts behind each other via such movement. The "snap movement" indicates a translational movement of the one panel towards the other panel, in the direction in the plane of the panels and perpendicular to the respective side edges, with the occurrence of a snap or click effect. That effect preferably is obtained by the rearward bending and subsequently, partially or entirely, springing back or relaxing of the rear lip. In that case the invention is particularly advantageous, as the rear lip, even in the secured position, can bend.

The coupling parts can be exclusively of the turning type and thus not of the snap type, or exclusively of the snap type and thus not of the turning type. Or the coupling parts can be of the turning and snap type, which means that the coupling parts allow coupling the panels via a turning movement, whether or not with a snap or click effect, as well as via a snap movement. The choice of the coupling movement then is up to the installer.

The coupling parts can be configured such that they, in the coupled condition, fit into each other with a pretension. This means that in the coupling a tension force is present which urges the panels, or the coupled side edges, at their front sides, towards each other. This tension force thus counteracts gap formation between the panels. The tension force preferably is realized in that the rear lip, in the coupled condition of the panels, is bent in rearward direction. Due to the invention, such permanent bending forms no problem at all, even with attachment of the panels on a hard substructure, for example, of wood or metal.

The invention does not exclude that the coupling parts fit into each other precisely and without tension or even fit into each other with a play. The play can be useful for absorbing expansion and/or shrinkage of the panels, for example, with wood-based panels which can expand or shrink under the influence of moisture.

An expansion space may be present between the coupled panels in order to absorb expansion and/or shrinkage of the panels, for example, under the influence of moisture and/or heat. Herein, it is no necessary that effectively play is provided between the coupled panels. As already described, the bendability of the rear lip can provide for a certain movability between the coupled panels.

The coupling parts can be realized partially, and preferably entirely, of the material of the panel and in one piece therewith. This is, for example, possible by means of cutting or milling treatments.

The panel can be secured to a substructure preferably by means of one or more attachment means. To this aim, for example, one of the aforementioned side edges, preferably the side edge with the female coupling part, can be configured such that an attachment element can be provided thereon. Preferably, the rear lip is configured such that an attachment element can be provided thereon.

A first type of attachment element that can be applied is an attachment element, such as a screw, tack, nail or staple. Such attachment element is provided through the respective side edge or through the rear lip and reaches up into the substructure.

With such type of attachment element, the front side of the rear lip preferably is provided with a stop surface. The attachment element can be provided through that stop surface in the rear lip. The stop surface does not necessarily have to be flat, but is, however, a surface which, for example, may be flat or may show a curvature.

The stop surface preferably is situated partially or entirely distal from the open or free end of the front lip. This renders the stop surface easily accessible. It is clear that for this purpose a longer rear lip is required.

The stop surface preferably is situated partially or entirely proximal from the recess in the rear side of the rear lip, which recess preferably is situated at the open end of the rear lip. In this manner, the possibility is offered to provide the attachment element away from the recess. Thereby, it can be prevented that the attachment element has a negative influence on the bendability of the rear lip.

The stop surface preferably is situated at a distance different from zero from the active locking zone defined by the locking parts. In this manner, it can be avoided that the attachment element has a detrimental influence on the respective locking.

Globally seen, the stop surface can be oriented parallel to the plane of the panel. However, it is not excluded that the stop surface, globally seen, has an inclined orientation. Preferably, in the last-mentioned case, the stop surface, globally seen, is oriented in distal direction towards the rear side of the panel. That allows providing the attachment element inclined towards the groove. It enhances the accessibility of the stop surface.

The stop surface can be situated partially or entirely behind a level running parallel to the plane of the panel, defined by the foremost point of the locking part at the female coupling part, in particular the locking part at the front side of the rear lip. That relatively deep position of the stop surface provides for that the coupling process experiences little to no hindrance from the attachment element.

The stop surface preferably is provided with a recess for receiving the attachment element. The recess in the stop surface can facilitate providing the attachment element. The recess can also function as an indication showing where the attachment element can be provided. The recess can be adapted such that the attachment element can be provided partially or entirely countersunk. The advantage thereof is that the provided attachment element has little to no influence on the coupling of the panels.

The recess in the stop surface preferably shows one or more of the following characteristics:

the recess is situated partially or entirely distal from the open or free end of the front lip;

the recess is situated partially or entirely proximal from the recess in the rear side of the rear lip;

the recess is situated at a distance different from zero from the active locking zone defined by the locking parts; and/or the recess is situated behind a level running parallel to the plane of the panel, defined by the foremost point of the locking part of the female coupling part, in particular the locking part on the front side of the rear lip.

The rear side of the rear lip preferably provides a support on a substructure, behind or at the location of the stop surface. In this manner, a good attachment of the panel on the substructure can be provided.

The stop surface can be provided with an indication, such as a color mark, in order to indicate where the attachment element can be provided. This makes it easy for the installer to know where to install the attachment element.

In the coupled condition a free space can be provided between the stop surface and the rear side of the tongue, for example, for a head of the attachment element, such as, for example, the head of a screw. This results in that the coupling process experiences little to not hindrance by the attachment element.

A second type of attachment element which can be used is an attachment element such as a clamping or clip system. Such system typically defines an opening in which an object can be clamped or provided. In order to secure the panel of the invention via such system, preferably the rear lip is adapted for being provided in the opening of the attachment element.

The use of other than the aforementioned types of attachment elements is not excluded.

It is noted that along the side edges more than one attachment element can be provided, for example, at a distance from each other.

The panel preferably is rectangular and oblong and thus preferably has a pair of long side edges and a pair of short side edges. The coupling parts preferably are situated at the long side edges. However, it is not excluded that coupling parts are also provided on the short side edges or are provided on the short side edges only. The coupling parts on the short side edges can show one or more of the herein above-mentioned characteristics.

The panel can be a ceiling-high wall panel. Then the panel typically is oblong and rectangular with on the long side edges the coupling parts and with short side edges made flat.

The oblong and rectangular panel can have a length of at least 2400, 2500 or 2600 millimeters.

The thickness of the panel may range, for example, from 5 to 15 millimeters.

The panel preferably is wood-based. The panel can comprise, for example, as a core a wood fiberboard, such as LDF (Low Density Fiberboard), MDF (Medium Density Fiberboard) or HDF (High Density Fiberboard), a particle board or plywood board. The use of MDF/HDF as a core material offers the advantage that precise coupling parts can be manufactured therefrom. The elasticity of MDF/HDF also allows elastically bending the rear lip without any noteworthy risk of breakage or damage.

The panel preferably has a decorative front and/or rear side, i.e. a front and/or rear side with a decor, for example, a wood or stone decor. The decorative front and/or rear side can be formed according to various possibilities:

the decorative front and/or rear side can be formed in that the panel comprises a carrier sheet printed with a decor, which carrier sheet is connected to the core of the panel, wherein the carrier sheet can be, for example, a preferably impregnated paper sheet, for example, impregnated with resin;

the decorative front and/or rear side can be formed by decor printed directly onto the core or on an undercoat layer or primer present on the core; or the decorative front and/or rear side can be formed by a paint and/or lacquer layer which is provided on the core of the panel.

In particular, the panel can be of the DPL (Direct Pressure Laminate) or HPL (High Pressure Laminate) type.

In an alternative, the panel can have a finishable front and/or rear side, for example, for subsequent finishing with a paint or lacquer layer, a fleece cloth, wallpaper or a digital print. In that case, the front and/or rear side can be provided with a primer or undercoat layer, for example, a lacquer carrier foil. It may relate to a so-called paintable panel.

The panel may comprise a backing layer or balancing layer at its rear side. This backing layer or balancing layer can comprise, for example, a preferably impregnated, for example, melamine-impregnated, paper sheet. Such backing layer is useful when such paper sheet is present on the front side of the panel, in order to provide for a balancing effect. In another example, the backing layer can comprise a lacquer carrier foil. This then can be useful when a lacquer carrier foil is present at the front side of the panel, for example, in a panel with finishable front side.

According to an independent second aspect, the invention relates to a wall or ceiling panel of the aforementioned type, wherein the front side of the rear lip is provided with a stop surface, through which stop surface an attachment element, such as a screw, can be provided; and wherein the stop surface comprises one or more of the following characteristics:

the stop surface is situated at a distance from the active locking defined by the locking parts;

the stop surface, globally seen, has an inclined orientation;

the stop surface is provided with a recess for receiving the attachment element;

the recess in the stop surface is situated at a distance from the active locking zone defined by the locking parts; and/or the stop surface is provided with an indication, for example, a color mark, in order to indicate where the attachment element can be provided.

The invention also relates to a wall or ceiling assembly, which comprises a wall or ceiling panel, herein in short named "panel", a substructure and an attachment element for securing the panel to the substructure; and wherein the panel is of the aforementioned type; with the characteristic that the rear lip, or at least a part thereof, in the attached position of the panel on the substructure, can bend in rearward direction. As already described, this characteristic provides for that the coupling of the panel is performed in a smoother manner. And there is less risk of breaking or damage of the coupling parts as the tongue does not have to be forced into the groove any more.

As already described, a possibility of allowing the bending of the rear lip, or at least a part thereof, in rearward direction, is to provide a recess on the rear side of the rear lip. This recess provides for that, between the rear lip and the substructure, a space or room is formed into which the rear lip can be placed.

However, the bending of the rear lip in general can be allowed in that, in the attached position of the panel, a space or free space is provided between the rear lip, or at least a part thereof, and the substructure, without a recess necessarily being present in the rear side of the rear lip.

Such space or free space can be realized, for example, by means of the attachment element. To this aim, the attachment element can comprise, for example, a leg, which is configured for bringing the rear side of the rear lip, or at least a part thereof, to a distance from the substructure and in this manner realize the space or free space. This can be, for example, the leg of a clamping or clip system, which is suitable for being provided at the respective side edge of the panel and in particular at the rear lip. The leg may comprise, for example, a step or a step-shaped portion in order to realize the space or free space.

The panel of the wall or ceiling assembly can show one or more of the characteristics of the panel according to the first and/or second aspect of the invention.

It is clear that the wall or ceiling assembly can comprise a plurality of panels, which, by means of one or more attachment elements, can be secured ton the substructure.

It is also noted that the invention cannot be applied with wall or ceiling panels only. The invention can be applied broader, with any type of panels. The invention is particularly useful with panels which are installed on a relatively hard substructure. Examples of such substructures are substructures of wood or metal.

BRIEF DESCRIPTION OF THE DRAWINGS

With the intention of better showing the characteristics of the invention, herein below, as an example without any limitative character, some preferred embodiments are described, with reference to the accompanying drawings, wherein.

DETAILED DESCRIPTION OF PREFERRED EMBODIMENTS OF THE INVENTION

Figure 1:
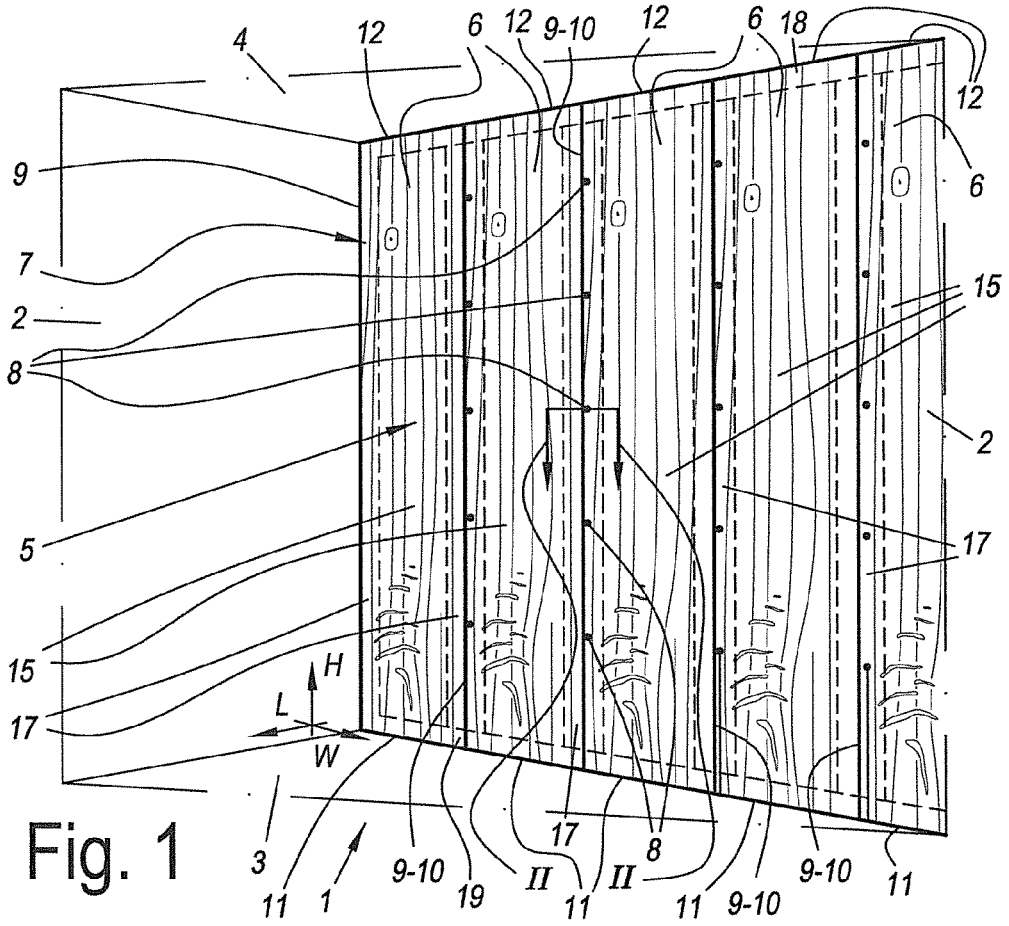
FIG. 1 represents a wall assembly.

FIG. 1 represents a room 1 comprising walls 2, a floor 3 and a ceiling 4.

Further, FIG. 1 represents a wall panel assembly 5, which is situated on one of the walls 2.

The wall panel assembly 5 comprises wall panels 6, a substructure 7 on which the wall panels 6 are secured, and attachment elements 8 with which the wall panels 6 are secured to the substructure 7.

In the represented example, the wall panels 6 are rectangular and oblong and thus have a pair of long side edges 9-10 and a pair of short side edges 11-12. The invention does not exclude that the wall panels have a different geometrical shape, such as, for example, square, and thus, in that case, have two pairs of equally long side edges.

The long side edges 9-10 are intended in particular for extending, in the attached position of the panels 6, in the height direction H of the room 1. The short side edges 11-12 then are intended for extending in the longitudinal direction L, or, as in the represented example, in the width direction W of the room 1.

The length of the wall panels preferably is at least 2400 millimeters, at least 2500 millimeters or at least 2600 millimeters. The width of the wall panels 6 can be situated, for example, between 300 and 1000 millimeters, margins included.

In the represented example, the wall panels 6 are so-called ceiling-high wall panels.

The wall panels 6 are coupled to each other at their long side edges 9-10 by means of coupling parts 13-14. In the represented example, however, the short side edges 11-12 are made flat. Thus, on the short side edges 11-12 no coupling parts or the like are provided. However, the invention does not exclude that on the short side edges 11-12, too, or only on the short side edges 11-12 and thus not on the long side edges 9-10, coupling parts are provided, which preferably are realized in accordance with the invention. This may be useful, for example, with smaller wall panels, i.e. wall panels which are not realized ceiling-high, in order to couple, for example, the wall panels on both pairs of side edges, or only on one pair of side edges, via the coupling parts.

The panels 6 are coupled to each other in a plane, namely the plane of the wall 2. That the panels 6 are coupled to each other in a plane means that the panels 6, in the coupled condition, are situated in the same plane, contrary to, for example, panels which, in the coupled condition, form a corner construction.

The wall panels 6 have a front side 15. This is the side of the panels 6, which, in the attached position of the panels 6, is directed away from the substructure 7. In the attached position, the front side 15 is visible and is directed towards the room 1. The panels 6 also have a rear side 16. This is the side which, in the attached position, is directed towards the substructure 7. The rear side 16 thus is directed away from the room 1. It is clear that with ceiling panels the same definition for the front and rear sides of the panels can be applied.

In the represented example, the front side 15 of the panels 6 is decorative. This means that the front side 15, preferably factory-produced, is provided with a single- or multi-colored decor, which, in the example shown, is a wood decor. A different decor, such as, for example, a stone decor, is not excluded.

In the example shown, the decor is a printed decor, as will be described herein below. However, in an alternative the decor may be formed by a paint or lacquer layer, whether or not provided on a primer or undercoat layer.

As in the represented example, the front side 15 may be a finished front side, i.e. a front side already finished at the factory. Thus, the user does not have to do anything in this respect.

In an alternative, however, within the scope of the invention, the front side may be partially finished or not yet finished. The front side then has to be finished by the user, if desired, for example, with a paint or lacquer layer, a fleece cloth, wallpaper or a digital print. Such front side can be provided with an undercoat layer or primer, for example, a lacquer carrier foil. An example of a panel with such partially finished or not yet finished front side is a so-called paintable panel.

The rear side 16 can also be decorative. The rear side 16 can be finished entirely, partially or not finished, such as described, for example, herein above in respect to the front side 15.

It is noted that the front and/or rear side of the panels 6 can be provided with a relief structure, which, for example, can simulate a natural product, such as wood or stone. The relief may or may not be realized in register with the possibly provided decor on the front and/or rear side.

In the example shown, the substructure 7 is a one-piece structure, for example, of wood or metal, which in particular comprises slats 17 extending in the height direction H of the room 1. The slats 17 are connected by means of an upper slat 18 and lower slat 19 extending in the longitudinal direction L or, as in the represented example, in the width direction W of the room 1. It is clear that, in an alternative, the middle structure of the substructure, instead of slats extending in the height direction of the room, as shown in the example, can comprise slats extending in the longitudinal direction or width direction of the room.

In still another alternative, the substructure may form a grid, whether or not in one piece, for example, of wood or metal, which comprises slats extending in the height direction of the room as well as comprises slats extending in the longitudinal or width direction of the room, in particular more than two.

In still another alternative, the substructure can comprise separate slats, for example, of wood or metal, which are provided, for example, directly on the wall or stone wall.

In the represented example, the attachment elements 8 are screws, which are provided along and on the long side edges 9-10 and at a distance from each other. However, the invention does not exclude that instead of screws, nails, tacks or staples, other similar attachment elements are applied.

Figure 2:
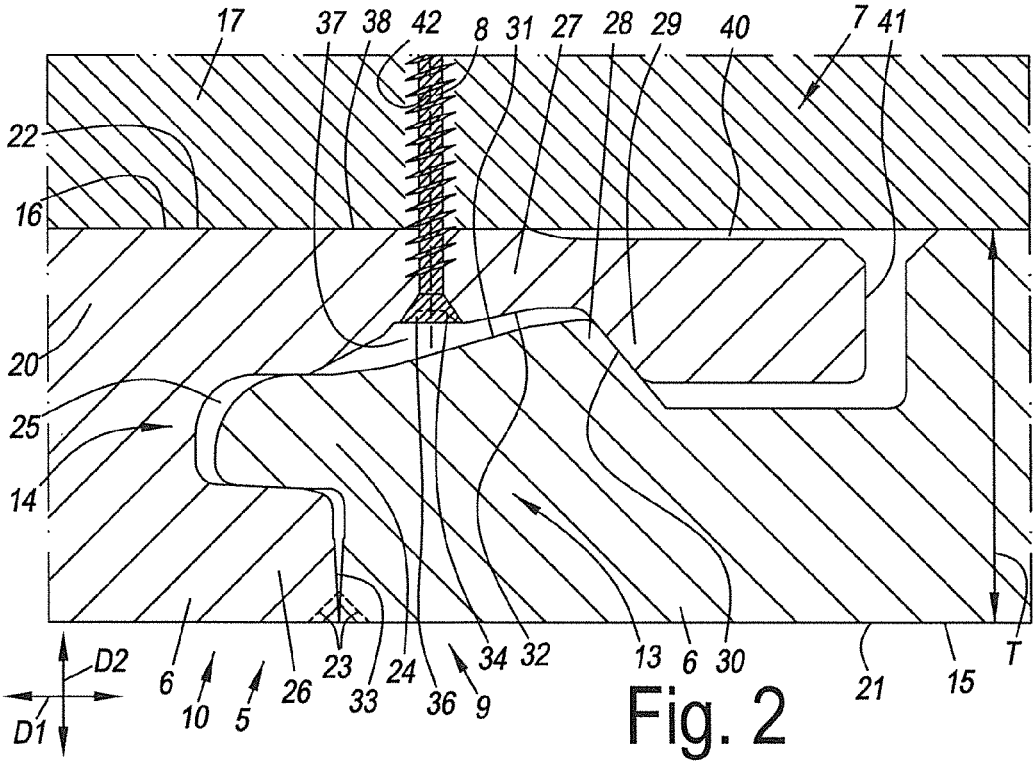
FIG. 2 represents a cross-section according to line II-II in FIG. 1.

As shown in FIG. 2, which represents the cross-section according to line II-II in FIG. 1, the wall panels 6 comprise a core 20, a decorative layer 21 situated at the front side of the core 20 and forming the decorative front side 15, and a backing layer or balancing layer 22 situated on the rear side of the core 20.

In the example shown, the core 20 comprises a wood fiberboard, which, in particular, is an MDF or HDF board. The advantage of this material is that it is possible to manufacture the coupling parts 13-14 therefrom stable and precise. The elasticity of MDF/HDF is also ideal for obtaining the necessary bendability in the coupling parts 13-14, without any significant risk of breaking, as will be described herein below.

The decorative layer 21 comprises a paper sheet printed with the wood decor, said sheet, however, not being represented in detail in FIG. 2. In particular, the paper sheet is impregnated, preferably with melamine. The paper sheet is connected to the core 20, for example, by means of a heated press device. In an alternative, the wood decor can be printed immediately or directly on the core 20, whether or not in the presence of a primer or undercoat layer, for example, by a digital printer, such as an inkjet printer.

The decorative layer 21 itself may or may not be composed of a plurality of layers. For example, a wear layer can be provided on the front side of the decor, and, in the example, on the front side of the printed paper sheet in order to protect the decor from wear. The wear layer may be, for example, a paper sheet, which preferably is impregnated, for example, with melamine. This paper sheet, whether or not together with the printed paper sheet, may be connected to the core 20, for example, by means of a heated press device.

The backing layer 22 comprises a paper sheet, which, however, is not represented in detail in FIG. 2. This paper sheet in particular is impregnated, preferably with melamine. In this manner, the backing layer 22 has a balancing effect, for example, in order to prevent that the panels 6 would warp.

It is clear that in order to obtain the balancing effect, the backing layer preferably is similar to, or has similar features as, the decorative layer or the layer present on the front side of the core.

The wall panels 6 are in particular panels of the DPL or HPL type.

The thickness T of the panels 6 preferably is situated between 5 to 15 millimeters, margins included, for example, 10 millimeters.

It is noted that the side edges 9-10, at the front side of the panels 6, can be provided with chamfers or bevels, which may or may not be provided with a decoration, such as a paint or lacquer layer. In FIG. 2, possible bevels 23 are represented in dotted line. The chamfers or bevels do not only provide for a plank effect, such that it is visually clearer that the panels 6 are separate panels or planks, but the chamfers or bevels do also increase the ease of installation, in particular with coupling parts 13-14 of the turning type, which becomes clear from FIG. 4, where the bevels 23 are shown schematically in dotted line.

Such chamfers or bevels may also be provided on the short side edges of the panels, or be provided on the short side edges only, for example, in the case of smaller panels, i.e. panels which are not made ceiling-high.

In the represented example, the coupling parts 13-14 are realized entirely from the material of the panels 6 and in one piece therewith. This is possible, for example, by milling the coupling parts 13-14 out of the panels 6.

The coupling part 13 comprises a tongue 24 and the coupling part 14 comprises a groove 25, which tongue 24 and groove 25, in the coupled condition, form a tongue and groove connection, which realizes a mechanical locking between the panels 6 in the direction D1 perpendicular to the plane of the panels 6, or thus perpendicular to the substructure 7 or the wall 2.

The groove 25 is bordered by a front lip 26, which is the lip bordering the groove 25 towards the front side 15 of the panels 6, and a rear lip 27, which is the lip bordering the groove 25 towards the rear side 16 of the panels 6.

The coupling parts 13-14 each comprise a locking part 28-29, which locking parts 28-29, in the coupled condition, realize a mechanical locking between the panels 6 in the direction D2 in the plane of the panels 6 and perpendicular to the side edges 9-10. Thus, the locking parts 28-29, in the coupled condition, counteract the moving apart of the tongue 24 and the groove 25 in the direction D2.

The locking parts 28-29 define an active locking zone 30. This is the zone where the locking parts 28-29, in the coupled condition, cooperate, or, in particular, come into contact in order to realize or to effect the locking in the direction D2.

The locking part 28 is provided in particular on the rear side 31 of the tongue 24. The locking part 29 is provided in particular on the front side 32 of the rear lip 27.

In the represented example, the rear lip 27 is longer than the front lip 26. By this is meant that the rear lip 27, in distal direction, i.e. in the direction away from the deepest point of the groove 25, extends beyond the open end 33 of the front lip 26. The longer rear lip 27 enhances the ease of installation.

In the example shown, the portion of the rear lip 27 which extends in distal direction beyond the front lip 26 is longer than the thickness T of the panels 6. This does not only facilitate installation, but it provides also for that more space is offered for providing the attachment elements 8 on or, in the example shown, in the rear lip 27.

The active locking zone 30 is situated in particular entirely beyond the open end 33 of the front lip 26.

The attachment element 8 is provided through the rear lip 27 up into the substructure 7. To this aim, the front side 32 of the rear lip 27 is provided with a stop surface 34. The attachment element 8 passes through this stop surface 34. This surface 34 is intended for cooperating with the carrier surface 35 of the attachment element 8.

In the represented example, the stop surface 34 is provided with a recess 36 for receiving the attachment element 8. The recess 36 is used in particular for being able to provide the attachment element 8 partially or, as in the example, entirely countersunk. The advantage thereof is that the attachment element 8 has no to little influence on the coupling of the panels 6, or, in other words, on inserting the tongue 24 into the groove 25.

Moreover, in the example, a space or free space 37 is provided between the stop surface 34 and the rear side 31 of the tongue 24, which can provide for that, during coupling or in the coupled condition, the rear side 31 of the tongue 24 does not come into contact with the attachment element 8, even if the attachment element 8 were not provided countersunk or only partially countersunk. Such space or free space can also be applied separately from the recess 36.

In the example shown, the stop surface 34 and the recess 36 in the stop surface 34 is situated entirely distal from the open or free end 33 of the front lip 26. This renders the stop surface 34 easily attainable for the attachment element 8.

Figure 3:
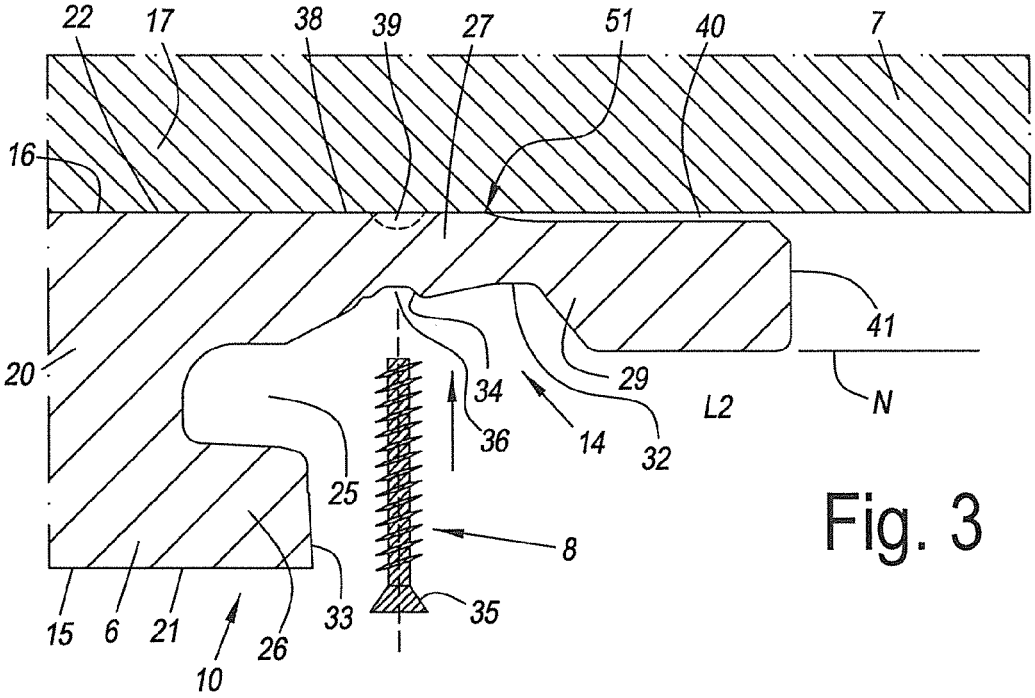
FIGS. 3 to 4 represent how the panels from FIG. 2 can be attached and coupled.

Globally seen, the stop surface 34 is running parallel to the plane of the panels 2. This provides for that the attachment element 8 can be provided perpendicular to the plane of the panels 6, as shown in FIG. 3.

In the example shown, the stop surface 34 and the recess 36 in the stop surface 34 is situated entirely behind or below a level N running parallel to the plane of the panels 6 and is defined by the foremost point, or most forward-situated point, of the locking part 29 on the front side 32 of the rear lip 27. Such stop surface 34 situated freely in downward direction provides for that the coupling process experiences little to no hindrance from the attachment element 8.

The support surface 34 and the recess 36 are situated at a distance different from zero from the active locking zone 30. This results in that the attachment of the panels 6 has little to no influence on the locking realized by the locking parts 28-29.

In the example, the rear side 38 of the rear lip 27 provides, behind the stop surface 34, for a support on the substructure 7. This support provides for a smooth and stable attachment of the panels 6 on the substructure 7. Such support does not exclude that, for example, at the location of the attachment element 8, a recess 39, represented in dotted line in FIG. 3, is provided. The recess 39 can be used for receiving a possible protrusion of material.

The characteristic of the invention, at least of the first aspect, is that the rear lip 27, or at least a part thereof, can bend in rearward direction, even if the panels 6 are attached to the flat substructure 7. To this aim, in the example shown the rear lip 27, at the rear side 38, is provided with a recess 40 which allows such rearward bending, as will be explained in more detail in respect to FIGS. 3 and 4.

In the example shown, the side bordering the recess 40 in upward direction is bent. In an alternative, however, this side may be completely straight and run, for example, rearward in an inclined manner in proximal direction. The side may be, for example, a flat inclined portion.

In the represented example, the recess 40 is provided at the open end 41 of the rear lip 27 and extends in particular in proximal direction, i.e. in the direction towards the deepest point of the groove 25, up to beyond the active locking zone 30. This provides for that the locking part 29 can easily tilt in rearward direction.

The recess 40 preferably is situated entirely distal from the open end 33 of the front lip 26. The most proximally-situated point 51 of the recess (40) is situated at a distance different from zero from the open or free end 33 of the front lip 26.

The stop surface 34, and the recess 36, is situated entirely proximal from the recess 40. This characteristic allows avoiding that the attachment element 8 would have a negative influence on the bendability of the rear lip 27.

FIG. 3 shows how to attach the panel 6 on the substructure 7. The attachment element 8 is provided in the rear lip 27 and more specifically through the stop surface 34, perpendicular to the plane of the panel 6. The stop surface 34 is easily attainable for the attachment element 8, as the stop surface 34 is situated entirely distal from the open end 33 of the front lip 26.

Figure 4:
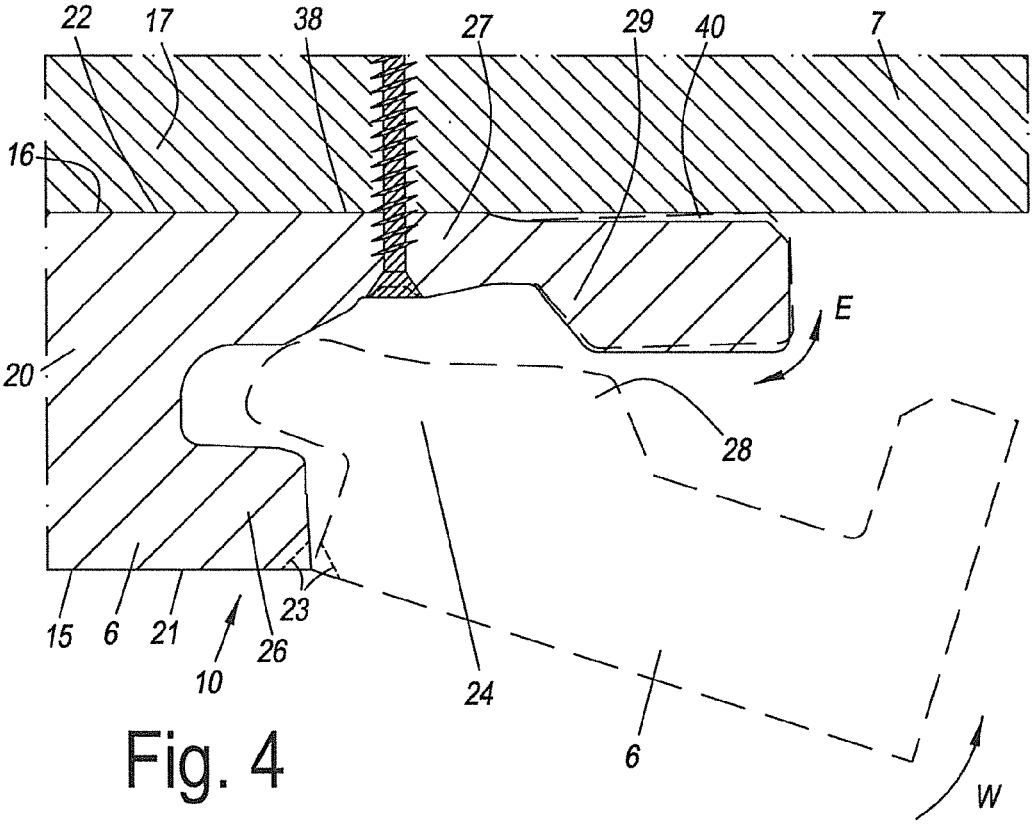

FIG. 4 shows how the following panel 6 can be coupled to the already secured panel 6, on the long side edges 9-10.

In the example shown, the coupling parts 13-14 are of the turning type. The panels 6 are coupled to each other by means of the turning movement W. In the turning movement W, here a snap or click effect will occur, which is obtained by a rearward bending of the rear lip 27 and subsequently, in the example entirely, springing back or relaxing of the rear lip 27, indicated by arrow E. The maximally bent condition of the rear lip 27 is indicated, in FIG. 4, in dotted line.

Bending the rear lip 27 provides for that the groove opening is enlarged. Thereby, the tongue 24 can be inserted into the groove 25 more easily. The rearward bending of the rear lip 27 provides, in particular, for a rearward tilting of the locking part 29, by which room is made for bringing the locking part 28 behind the locking part 29.

From FIG. 4 it is evident that the recess 40 allows the rearward bending of the rear lip 27 and the rearward tilting of the locking part 29.

It is also evident that during the coupling process no hindrance is experienced from the attachment element 8, in that this element 8 is provided countersunk.

In the example, the coupling parts 13-14 are exclusively of the turning type.

It has already been mentioned that, when completing the turning movement W, the rear lip 27 springs back or relaxes completely. The coupling parts 13-14 fit into each other precisely and without tension, and there is no play present in the coupling.

In an alternative, it is possible that the rear lip 27 does not spring back or relax completely and thus, in the coupled condition, is bent in rearward direction and thereby delivers a tension force which urges the coupled side edges 9-10, on the front side 15 of the panels 6, towards each other. Such tension force counteracts gap formation between the coupled panels 6. The bent condition of the rear lip 27 in the coupled condition of the panels 6 is possible due to the recess 40 on the rear side 38 of the rear lip 27.

Figure 5:
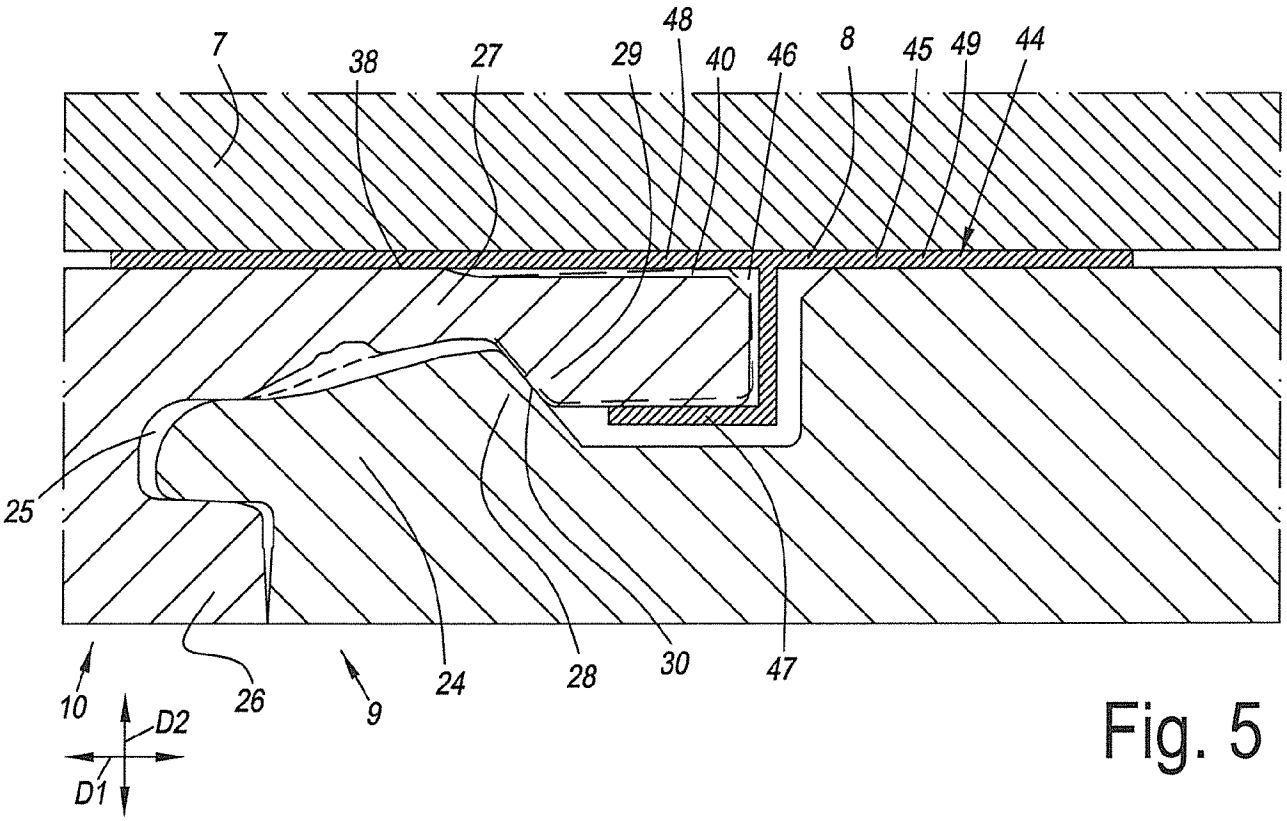
FIGS. 5 to 7 represent alternative embodiments.

FIG. 5, according to a view as in FIG. 2, represents an alternative. In the example shown, the panels 6 are attached to the understructure 7 by means of a clamping or clip system 44.

The clamping system 44 comprises a basis 45, which is connected to the substructure 7 via an accessory, such as a screw.

The clamping system 44 is provided on the side edge 10 of the panel 6 and in particular is provided on the rear lip 27 and still more in particular on the open end 41 of the rear lip 27. To this aim, the clamping system 44 comprises an opening 46, in which the rear lip 27, or at least a part thereof, can become seated.

The opening 46 is formed or bordered by a front leg 47 and a rear leg 48, which here forms part of the basis 45 of the clamping system. In the example shown, the front leg 47 is provided over the rear lip 27, however, in an alternative, can also be provided in a recess at the open end of the rear lip 27. The rear leg 48 rests or is supported on the substructure 7. In the example, the rear leg 48 extends in proximal direction farther than the recess 40, as a result of which this leg 48 is in contact with the rear side 16 of the panel 6.

The other leg 49 of the basis, i.e. the leg extending in distal direction and thus away from the groove 25, is, via the accessory, connected to the substructure 7. The leg 49, too, is in contact with the rear side 16 of the respective panel 6.

It is noted that, in a not-represented alternative, the clamping system can be provided on the side edge with the first coupling part. To this aim, this side edge can be provided with a recess in which a leg of the clamping system can be placed.

Figure 6:
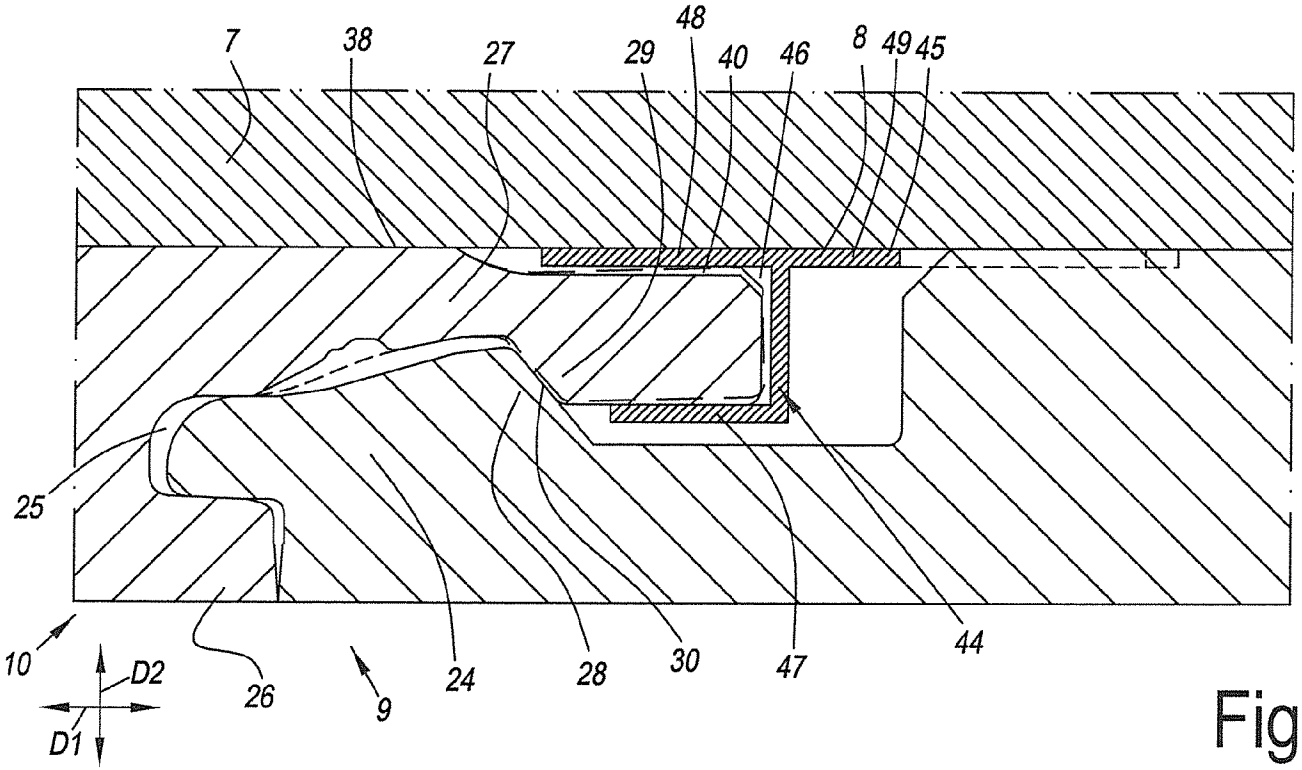

FIG. 6 shows an alternative clamping system 44. Here, the rear leg 48 is realized shorter. The open end thereof is situated in the recess 40 on the rear side 38 of the rear lip 27. The rear leg 48 is free from contact with the rear side 16 of the panel 6. The other leg 49 is realized shorter as well; however, this is not necessarily the case, as indicated in dotted line. In the example shown, the other leg 49 also is free from contact with the rear side 16 of the respective panel 6.

Figure 7:
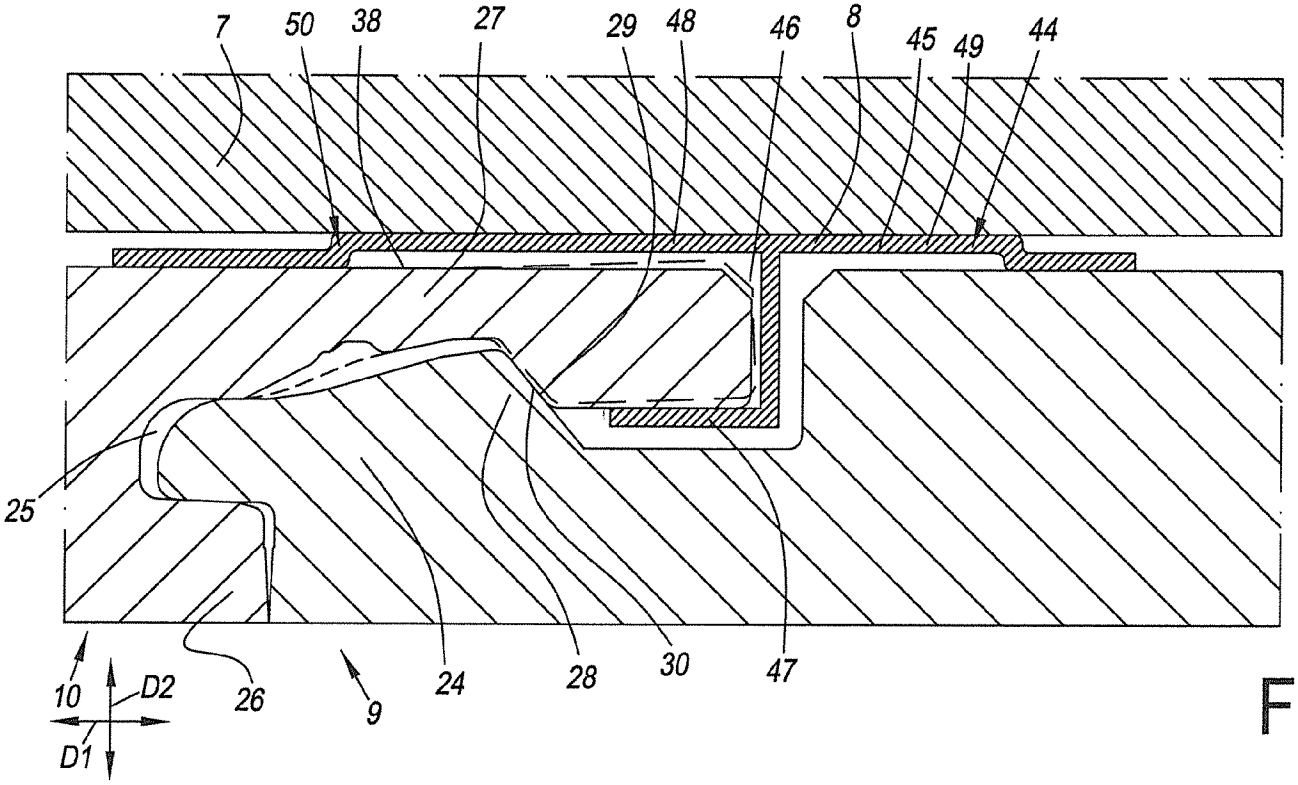

FIG. 7 represents another alternative clamping system 44. Here, the rear leg 48 is configured for bringing the rear side 38 of the rear lip 27, or at least a part thereof, to a distance from the substructure 7. To this aim, the leg 48, in the example, comprises a step or step-shaped portion 50. Thereby, no recess is necessary on the rear side 38 of the rear lip 27 in order to allow the bending of the rear lip 27.

Figure 8:
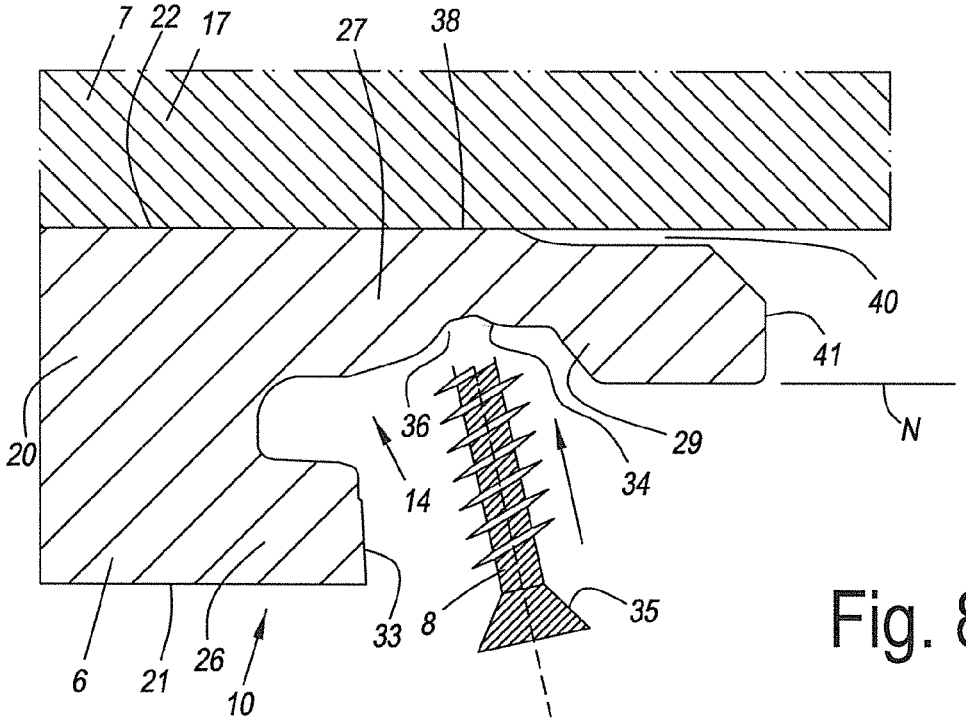
FIGS. 8 and 9 represent another alternative embodiment.
Figure 9:
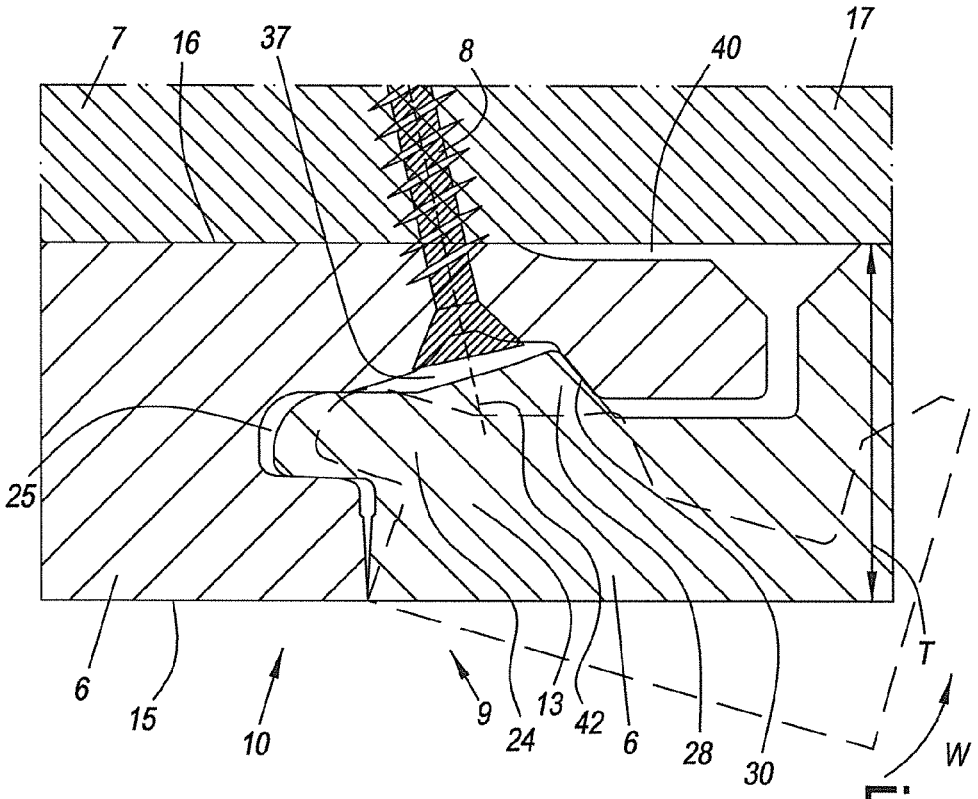

FIGS. 8 and 9 represent another alternative. Here, the stop surface 34, globally seen, is running inclined and thus forms an angle, different from zero, with the plane of the panels 6. The stop surface 34 in particular runs rearward in distal direction. Such inclined stop surface 34 is easily attainable, as the attachment element 8 can be provided in an inclined manner, as shown in FIG. 8. The inclined stop surface 34 allows in particular using a wider attachment element, with which a more stable connection with the substructure can be obtained.

Figure 10:
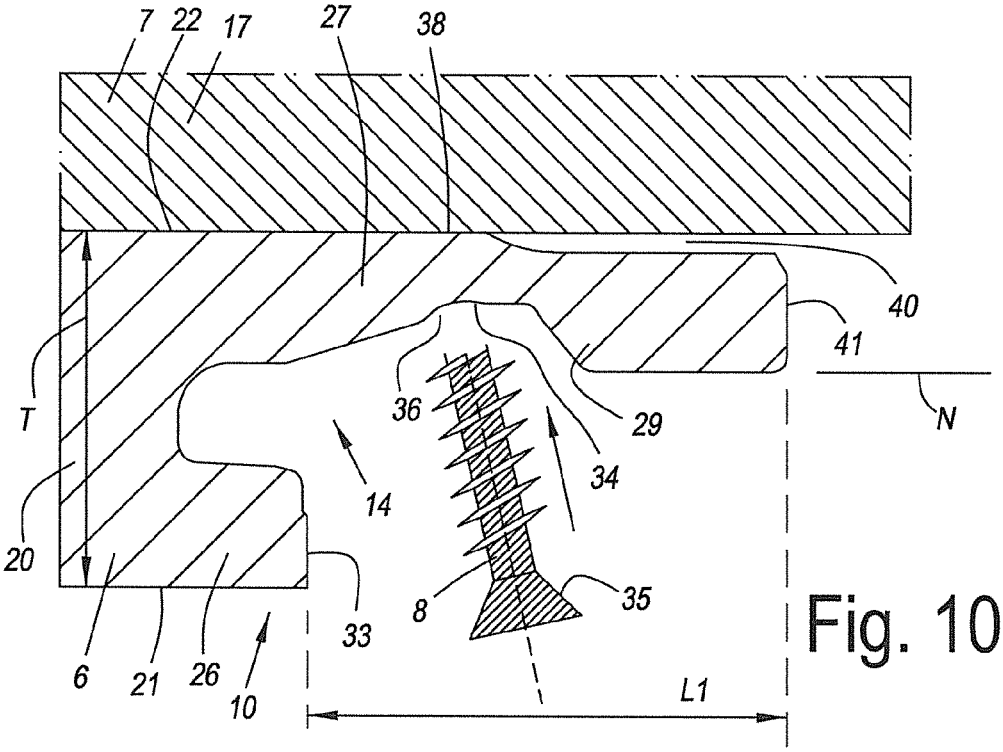
FIGS. 10 and 11 represent a further alternative embodiment.
Figure 11:
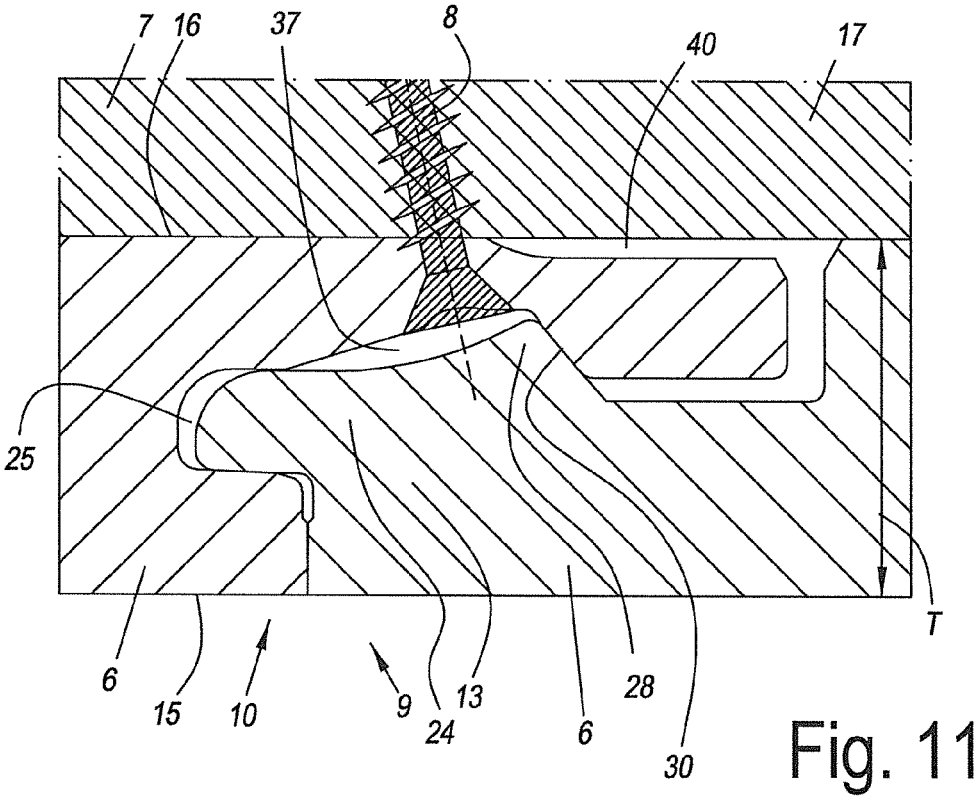

FIGS. 10 and 11 represent a further alternative. A first particularity of this embodiment is that, in respect to that from FIGS. 8 and 9, the free space 37 is made larger, which here specifically is effected by the curved configuration of the rear side of the tongue 24. This relatively large space 37 has the effect that the tongue, during coupling or in coupled condition, experiences no or almost no hindrance from the attachment element 8, even if this latter would not be provided countersunk or provided only partially countersunk. A second particularity is that the rear lip 27 is made relatively long. The distance L1 over which the rear lip 27 protrudes beyond the free end of the front lip 26 is at least 1.2 times, and preferably 1.3 times, the thickness T of the panel 6. The relatively long rear lip 27 has, amongst others, the effect that the ease of installation of the panels 6 is enhanced.

It is noted that there, where a pair of long and short side edges is mentioned, this can be interpreted more broadly, as a first pair and a second pair of side edges, without exceeding the scope of the invention.

It is also noted that it is not excluded to use an adherence agent, such as glue or the like, in the coupling between the panels. The adherence agent may be applied or provided, for example, on the male and/or the female coupling part, for example, on the front side of the rear lip and/or the rear side of the tongue. The adherence agent has as an effect that the locking between the panels is enhanced. This is particularly advantageous with the panels of the invention, which have a recess on the rear side of their rear lip, or wherein the rear lip thereof can bend in another manner, in that this bending possibility of the rear lip can somewhat weaken the locking between the panels. Thus, the adherence agent can compensate the possible weakening.

The adherence agent can be provided by the installer of the panels during the installation thereof. To this aim, it is useful that the panels are provided with a mark which indicates where the glue or the adherence agent has to be applied, for example, on the front side of the rear lip and/or the rear side of the tongue.

It is not excluded that the adherence agent is provided beforehand, for example, during manufacture. The adherence agent then can be activated when installing the panels, for example, by chemical activation and/or by removing a covering layer.

In view of the above, the invention, according to an independent aspect, relates to a wall or ceiling assembly which comprises wall or ceiling panels, wherein these panels, on at least one pair of side edges, are provided with coupling parts, which are configured such that they allow coupling the panels and effecting a mechanical locking between these panels; and wherein the locking between these panels is also effected by an adherence agent or glue. Further, the panels can show one or more of the preceding characteristics, separately or in combination. According to still another independent aspect, the invention also relates to a method for installing wall or ceiling panels, wherein these panels, on at least one pair of side edges, are provided with coupling parts, which are configured such that they allow coupling the panels and effecting a mechanical locking between these panels; and wherein this method comprises at least the following steps:

installing a first panel;

providing an adherence agent or glue on the first and/or a second panel; and installing a second panel and thereby coupling this panel to the first-mentioned panel.

The adherence agent or the glue preferably is applied at the location of the coupling parts, for example, in the case that the coupling parts comprise and tongue and groove connection, on the front side of the rear lip and/or on the rear side of the tongue. The adherence agent or the glue can be provided along the entire side edge of the respective panel or along a limited portion of the side edge of the panel.

According to a particular independent aspect, the invention relates to a wall or ceiling panel which is better resistant against damage when connecting the coupling parts which are present. To this aim, the invention, according to the present particular and independent aspect, relates to a wall or ceiling panel, which, on one side edge of the panel, comprises a male coupling part and, on an opposite side edge of the panel, comprises a female coupling part, wherein the coupling parts are configured such that two of such panels, by means of the coupling parts, can be coupled to each other in a plane and thus a coupled condition can be realized between the panels; wherein the male coupling part comprises a tongue and the female coupling part comprises a groove, wherein the aforementioned tongue and groove, in the coupled condition, form a tongue and groove connection, which realizes a mechanical connection between the panels in the direction perpendicular to the plane of the panels; wherein the groove is bordered by a front lip and a rear lip, and wherein the coupling parts each comprise a locking part, wherein the aforementioned locking parts, in the coupled condition, realize a mechanical locking between the panels in the direction in the plane of the panels and perpendicular to the side edges, characterized in that the panel forms a ceiling-high wall panel and/or has a length of at least 2400 mm, and that the panel shows one or a combination of two or more of the following features:

the feature that the panel has a width-to-length ratio smaller than 1/20 and preferably larger than 1/60;

the feature that the panel has a water-resistant front and rear side;

the feature that the panel has a melamine layer on the front and rear sides;

the feature that the panel has a lacquer layer on the front and rear sides, for example, an acrylic-based, preferably UV-hardened lacquer layer;

the feature that the panel comprises a water-tight foil on the front and rear sides, such as a PVC (Polyvinylchloride) foil, a PET (Polyethylene terephthalate) foil, a PP (Polypropylene) foil or the like, the feature that the panel comprises a waterproof material as a core, for example, a core which is based on a, whether or not filled, synthetic material, such as on filled PVC.

The invention of the above-mentioned particular independent aspect reduces the risk of damage with long panels, for example, with panels intended for the ceiling-high finishing of rooms. The inventor has found that the damage is due in particular to bending or deformation of the panels as a result of moisture influences. By now choosing the width-to-length ration sufficiently large, namely, less than 1/20 and preferably less than 1/35, the zone with the coupling means, at the location of which a moisture-sensitive core, such as MDF or HDF, might be exposed to the air moisture present on the working site, is limited. By selecting a water-resistant or water-tight front and rear side, the effect of the air moisture on the large surfaces of the panels is limited. Well-known possibilities for this are melamine layers, lacquer layers and water-tight foils. The first-mentioned features are of particular importance with panels with a water-sensitive core, such as with wood-based cores, in particular with panels with a core of MDF/HDF or wood particleboard. According to a particular possibility, the problems with damage may also be avoided by choosing a core of a waterproof material, such as a core of PVC filled with lime or sand, or a core of a mineral-based plate, such as of cement fiberboard or gypsum fiberboard. In these last-mentioned two cases, a fire-retardant panel is obtained as well.

It is evident that the panels according the above-mentioned particular aspect can show the preferred characteristics of the panels of the above-mentioned aspects of the invention, without herein requiring that the rear lip has to be made bendable.

The present invention is in no way limited to the herein above-described embodiments, on the contrary may such wall or ceiling panels and wall or ceiling assemblies be realized according to various variants, without leaving the scope of the present invention.

The invention claimed is:

1. A wall or ceiling panel, which, on one side edge of the panel, comprises a male coupling part and, on an opposite side edge of the panel, comprises a female coupling part, wherein the male and female coupling parts are configured such that two of such panels, by means of the male and female coupling parts, can be coupled to each other in a plane and a coupled condition can be realized between the panels;

wherein the male coupling part comprises a tongue and the female coupling part comprises a groove, wherein the tongue and the groove, in the coupled condition, form a tongue-and-groove connection, which realizes a mechanical locking between the panels in a direction perpendicular to the plane of the panels;

wherein the groove is bordered by a front lip and a rear lip;

wherein the male and female coupling parts each comprise a locking part, wherein the locking part of the male coupling part and the locking part of the female coupling part, in a coupled condition, realize a mechanical locking between the panels in a direction in the plane of the panels and perpendicular to the side edges;

wherein the panel forms a ceiling-high wall panel and/or has a length of at least 2400 mm;

wherein the male and female coupling parts are respectively defined at long side edges of the panel;

wherein the front lip extends substantially parallel to the plane of the panels, and the rear lip of the groove extends substantially parallel to the front lip with a distal end of the rear lip extending parallel to the plane of the panels;

wherein a portion of the rear lip which, oriented in a distal direction, extends beyond an open or free end of the front lip and is longer than a thickness of the panel;

wherein a front side of the rear lip defines a locking element comprising a flat surface parallel to the panel;

wherein the locking part of the male coupling part is provided on the rear side of the tongue such that the locking part of the male coupling part is located distally from the front lip; wherein the locking part of the female coupling part is provided on the front side of the rear lip;

wherein each of the locking parts defines an inclined planar section, wherein the planar sections of the locking parts contact each other in the coupled condition, wherein the locking parts lock in the direction in the plane of the panels and perpendicular to the side edges;

wherein the panel defines short side edges perpendicular to the long side edges, and the short side edges of the panels are devoid of coupling parts.

2. The wall or ceiling panel of claim 1, wherein the panel shows one or more of the following characteristics:

the rear lip extends in distal direction beyond the open or free end of the front lip;

an active locking zone defined by the locking parts is situated partially or entirely beyond the open or free end of the front lip;

the male and female coupling parts are configured such that they, in the coupled condition, fit into each other with pretension;

the male and female coupling parts are realized entirely from a material of the panel and in one part therewith;

the panel has a width-to-length ratio smaller than 1/20 and larger than 1/60;

the panel has a water-resistant front and rear side;

the panel has a melamine layer on the front and rear sides;

the panel has a UV-hardened lacquer layer on the front and rear sides;

the panel comprises a water-tight foil on the front and rear sides, selected from a group consisting PVC (Polyvinylchloride) foil, a PET (Polyethylene terephthalate) foil, and a PP (Polypropylene) foil.

3. The wall or ceiling panel of claim 1, wherein one of the side edges is configured such that an attachment element can be provided thereon in order to secure the panel to a substructure.

4. The wall or ceiling panel of claim 1, wherein the rear lip is configured such that an attachment element can be provided thereon.

5. The wall or ceiling panel of claim 4, wherein the front side of the rear lip is provided with a stop surface defined as a recess configured and dimensioned as a countersink to receive a carrier surface of an attachment element adapted to be provided in the rear lip.

6. The wall or ceiling panel of claim 5, wherein the stop surface shows one or more of the following characteristics:

the stop surface is situated partially or entirely distal from an open or free end of the front lip;

the stop surface is situated at a distance different from zero from an active locking zone defined by the locking parts;

the stop surface, globally seen, is oriented parallel to the plane of the panel;

the stop surface, globally seen, is oriented inclined; and/or the stop surface is situated partially or entirely behind a level running parallel to the plane of the panel, defined by a foremost point of the locking part of the female coupling part, the foremost point of the locking part being on the front side of the rear lip.

7. The wall or ceiling panel of claim 5, wherein the stop surface is provided with a recess for receiving the attachment element.

8. The wall or ceiling panel of claim 5, wherein the recess is a blind hole.

9. The wall or ceiling panel of claim 5, wherein the recess is provided such that the attachment element can be provided countersunk.

10. The wall or ceiling panel of claim 5, wherein the recess in the stop surface is situated partially or entirely distal from the open or free end of the front lip.

11. The wall or ceiling panel of claim 5, wherein the rear side of the rear lip behind or at the location of the stop surface is provided for supporting on a substructure.

12. The wall or ceiling panel of claim 5, wherein the stop surface is located proximally from the locking part.

13. The wall or ceiling panel of claim 1, wherein the panel is wood based and wherein the panel comprises a decorative layer provided at the front face of the panel.

14. The wall or ceiling panel of claim 1, wherein the panel comprises a material as a core which is based on a, whether or not filled, synthetic material.

15. The wall or ceiling panel of claim 1, wherein the male and female coupling parts are arranged for coupling by turning the male couple part into the female coupling part.

16. The wall or ceiling panel of claim 1, wherein a front side of the rear lip and a rear side of the tongue define a free space located therebetween, a segment of the rear side of the tongue bordering the free space is arranged asymmetrically relative to the rear side of the rear lip.

17. The wall or ceiling panel of claim 16, wherein at least a segment of the front side of the rear lip bordering the free space is inclined relative to a plane of the panel.

18. The wall or ceiling panel of claim 16, wherein the segment of the rear side of the tongue is inclined relative to the front side of the rear lip.

19. The wall or ceiling panel of claim 18, wherein the rear side of the tongue is curved.

20. A wall or ceiling assembly comprising:

a wall or ceiling panel; and an attachment element for securing the panel to a substructure; wherein the attachment element comprises a screw;

wherein the wall or ceiling panel, which, on one side edge of the panel, comprises a male coupling part and, on an opposite side edge of the panel, comprises a female coupling part, wherein the male and female coupling parts are configured such that two of such panels, by means of the male and female coupling parts, can be coupled to each other in a plane and a coupled condition can be realized between the panels;

wherein the male coupling part comprises a tongue and the female coupling part comprises a groove, wherein the tongue and the groove, in the coupled condition, form a tongue-and-groove connection, which realizes a mechanical locking between the panels in a direction perpendicular to the plane of the panels;

wherein the groove is bordered by a front lip and a rear lip;

wherein the male and female coupling parts each comprise a locking part, wherein the locking part of the male coupling part and the locking part of the female coupling part, in a coupled condition, realize a mechanical locking between the panels in a direction in the plane of the panels and perpendicular to the side edges;

wherein the panel forms a ceiling-high wall panel and/or has a length of at least 2400 mm;

wherein the male and female coupling parts are respectively defined at long side edges of the panel;

wherein the front lip extends substantially parallel to the plane of the panels, and the rear lip of the groove extends substantially parallel to the front lip with a distal end of the rear lip extending parallel to the plane of the panels;

wherein the front side of the rear lip is provided with a stop surface defined as a recess configured and dimensioned as a countersink to receive a carrier surface of the screw adapted to be provided in the rear lip for securing the panel to a substructure;

wherein a portion of the rear lip which, oriented in a distal direction, extends beyond an open or free end of the front lip and is longer than a thickness of the panel;

wherein a front side of the rear lip defines a locking element comprising a flat surface parallel to the panel;

wherein the locking part of the male coupling part is provided on a rear side of the tongue such that the locking part of the male coupling part is located distally from the front lip; wherein the locking part of the female coupling part is provided on the front side of the rear lip;

wherein each of the locking parts defines an inclined planar section, wherein the planar sections of these locking parts contact each other in coupled condition, wherein the locking parts lock in the direction in the plane of the panels and perpendicular to the side edges;

wherein the panel defines short side edges perpendicular to the long side edges, and the short side edges of the panels are devoid of coupling parts.

21. The wall or ceiling assembly of claim 20, wherein the recess is a blind hole.

22. The wall or ceiling assembly of claim 20, wherein the recess is provided such that the attachment element can be provided countersunk.

23. The wall or ceiling assembly of claim 20, wherein the recess in the stop surface is situated partially or entirely distal from the open or free end of the front lip.

24. The wall or ceiling assembly of claim 20, wherein the rear side of the rear lip behind or at the location of the stop surface is provided for supporting on a substructure.

25. The wall or ceiling assembly of claim 20, wherein the stop surface is located proximally from the locking part.

* * * * *